US005423532A

United States Patent [19]

Huang

[11] Patent Number: 5,423,532

[45] Date of Patent: Jun. 13, 1995

[54] DOUBLE-STRUNG GAME RACQUET AND METHOD FOR STRINGING

[76] Inventor: Hung C. Huang, 9418 NE. 136 St., Kirkland, Wash. 98034-1815

[21] Appl. No.: 109,592

[22] Filed: Aug. 20, 1993

[51] Int. Cl.[6] ..... A63B 51/06
[52] U.S. Cl. ..... 273/73 D
[58] Field of Search ..... 273/73 R, 73 C, 73 D

[56] References Cited

U.S. PATENT DOCUMENTS

| | | | |
|---|---|---|---|
| 1,409,621 | 3/1922 | Tournier | 273/73 D |
| 1,502,845 | 7/1924 | Blache | 273/73 D |
| 1,687,848 | 10/1928 | Robinson et al. | 273/73 D |
| 3,968,966 | 7/1976 | D'Aquanni | 273/73 D |
| 4,141,549 | 2/1979 | Hayes et al. | 273/73 D X |
| 4,320,900 | 3/1982 | Blackburne | 273/73 D |

FOREIGN PATENT DOCUMENTS

| | | | |
|---|---|---|---|
| 1050581 | 3/1979 | Canada | 273/73 C |
| 3739433 | 6/1989 | Germany | 273/73 D |
| 3924674 | 12/1989 | Germany | 273/73 D |
| 2239809 | 7/1991 | United Kingdom | 273/73 D |

OTHER PUBLICATIONS

*The Stringer's Digest,* "Two Piece Stringing", U.S. Racket Stringer's Association, 1987, p. 9.

*Primary Examiner*—William E. Stoll
*Attorney, Agent, or Firm*—Fish & Richardson

[57] ABSTRACT

A double-strung game racquet includes a headframe with two parallel playing surfaces, each forming an area at least as large as an area bounded by an external perimeter of the headframe. The playing surfaces are formed using two strings, a horizontal tensioned string to form horizontal components of the two surfaces interwoven with a vertical tensioned string to form vertical components of the two surfaces. The headframe has two rows of corresponding holes formed therein, and each string is wrapped around the headframe in such a way that the strings repeatedly pass over an outside peripheral edge on a first side of the headframe, across to an opposite side of the headframe, over an outside peripheral edge of the opposite side, in through a hole, out through an adjacent hole, over another outside peripheral edge of the opposite side, and across to the first side. Each string is threaded out through a vertically adjacent hole on one side of the headframe and out through a horizontally adjacent hole on the opposite side of the headframe.

12 Claims, 10 Drawing Sheets

DOUBLE-STRUNG GAME RACQUET AND METHOD FOR STRINGING

FIELD OF THE INVENTION

This invention relates to a game racquet.

BACKGROUND OF THE INVENTION

Conventional game racquets for playing tennis, racquetball, squash or other games have their playing surfaces formed by opposite sides of a single interwoven, tensioned string bed lying in a central plane of the head frame of the racquet and spanning the central opening bounded by the head frame.

Double-strung racquets, that is racquets which have their playing surfaces formed by mutually parallel separate sets of interwoven tensioned strings in planes bounded by the outer edges of the head frame, have been proposed.

While the advantages of double-strung racquets are well known, it has previously been impractical to produce them in a cost effective and efficient manner.

In one technique of making double-strung racquets, as disclosed in U.S. Pat. No. 4,320,900, the racquets require a specially made frame with holes and grooves formed in the outside edges. This type of racquet requires a large number of strings, one for each vertical and horizontal line or component of the playing surfaces. Each string must be knotted at both ends, strings of different lengths are required, and a special tool is needed to thread the strings into the holes and grooves. Another disadvantage of a racquet of this type is that the strings soon lose their original tension, no matter how they are anchored or knotted.

In another technique of making double-strung racquets, as disclosed in U.S. Pat. No. 3,968,966, a specially designed frame including an elongated band with a T-shaped cross section is used. Grooves are cut into the outside edges of the frame and two single strings are wrapped around the outside edges of the frame to form the required two parallel surfaces. There is no interaction between the strings of each surface.

The racquet of this second type suffers from a number problems and disadvantages, both in its manufacture and use.

First, the T-shaped cross section increases the wind resistance of the racquet. In general, the head frame of a racquet should be streamlined to permit the free flow of air around the racquet. A racquet design that impedes this free air flow is unsuitable for serious game playing.

Second, by placing the strings in grooves on the outside edges of the frame, the frame can come into direct contact with a ball, thereby causing the ball to be misdirected when struck. When a ball comes into contact with the inner edge of the frame of a conventional racquet, it is ineffective in controlling the direction of the ball.

Third, using two independent strings to create the two parallel surfaces, one string for each surface, can easily create uneven pulling and distortion of the frame while it is being strung. To avoid this problem it would be necessary to use exactly the same tension on the top and bottom strings simultaneously.

A fourth disadvantage of having two independently strung playing surfaces is that the faces vibrate unevenly when a ball is struck. Thus the frame as a whole does not absorb the shock evenly.

It is desirable to produce a double-strung racquet which uses a conventional frame, does not require special strings or tools to string, and is easy to make. It is also desirable to produce such a racquet without increasing the wind resistance of the racquet. It is further desirable to have a double-strung racquet with playing surfaces as large as the outside circumference of the head frame, and not one in which the size of the playing surfaces has been reduced.

It is further desirable to produce a double-strung racquet which can be strung without uneven pulling of the head frame.

SUMMARY OF THE INVENTION

In general this invention features a double strung game racquet having a headframe with two mutually parallel playing surfaces formed thereon using two strings and a method for stringing such a racquet. A horizontal string forms horizontal components of the two surfaces, and a vertical string forms vertical components of the two surfaces. The horizontal and vertical strings are tensioned and interwoven on each racquet face.

In some preferred embodiments the playing surfaces each form an area at least as large as the area bounded by the external perimeter of the headframe.

In some embodiments the headframe has two rows of mutually corresponding holes formed therein. Each of the horizontal and vertical strings passes over outer top and bottom edges of the headframe and through the holes.

In some embodiments each string is wrapped around the headframe in such a way that the strings repeatedly pass over an outside peripheral edge on a first side of the headframe, across to an opposite side of the headframe, over an outside peripheral edge of the opposite side, in through a hole, out through an adjacent hole, over a second outside peripheral edge of the opposite side, and across to the first side. Each string is threaded out through a vertically adjacent hole on one side of the headframe and out through a horizontally adjacent hole on the opposite side of the headframe.

In some embodiments this invention features a double strung game racquet having a headframe with two parallel playing surfaces, each forming an area at least as large as the area bounded by the external perimeter of the headframe, formed thereon using a horizontal tensioned string to form horizontal components of the two surfaces interwoven with a vertical tensioned string to form vertical components of the two surfaces, and further wherein the headframe has two rows of corresponding holes formed therein, and wherein each string is wrapped around the headframe in such a way that the strings repeatedly pass over an outside peripheral edge on a first side of the headframe, across to an opposite side of the headframe, over an outside peripheral edge of the opposite side, in through a hole, out through an adjacent hole, over another outside peripheral edge of the opposite side, and across to the first side, wherein each string is threaded out through a vertically adjacent hole on one side of the headframe and out through a horizontally adjacent hole on the opposite side of the headframe.

This invention features a method of stringing a double strung game racquet having a headframe with two parallel playing surfaces formed thereon, including the steps of forming horizontal components of the two surfaces with a horizontal string, and forming vertical components of the two surfaces with a vertical string.

In some embodiments, the headframe has two rows of corresponding holes formed therein, and the steps of forming comprise passing the strings over outer top and bottom edges of the headframe and through the holes.

In some embodiments, the headframe has two rows of corresponding holes formed therein, and the steps of forming include repeatedly wrapping each string around the headframe in such a way that the strings pass over an outside peripheral edge on a first side of the headframe, across to an opposite side of the headframe, over an outside peripheral edge of the opposite side, in through a hole, out through an adjacent hole, over another outside peripheral edge of the opposite side, and across to the first side. The wrapping is repeated until the playing surfaces are completely formed.

In some embodiments the wrapping further comprises the steps of threading each string out through a vertically adjacent hole on one side of the headframe, and threading each string out through a horizontally adjacent hole on the opposite side of the headframe.

In some embodiments this invention features a method of stringing a double strung game racquet having a headframe with two parallel playing surfaces formed thereon and having two rows of corresponding holes formed therein, the method comprising the steps of forming horizontal components of the two surfaces with a horizontal string, and forming vertical components of the two surfaces with a vertical string. The steps of forming comprise the steps of wrapping each string around the headframe in such a way that the strings pass over an outside peripheral edge on a first side of the headframe, across to an opposite side of the headframe, over an outside peripheral edge of the opposite side, in through a hole, out through an adjacent hole, over a second outside peripheral edge of the opposite side, and across to the first side; and repeating the step of wrapping until the playing surfaces are completely formed; the step of wrapping further includes the steps of threading each string out through a vertically adjacent hole on one side of the headframe, and threading each string out through a horizontally adjacent hole on the opposite side of the headframe.

The racquet of this invention is advantageous in that it can be made using any conventional racquet frame, it does not increase wind resistance, and it does not reduce the size of the playing surfaces. Furthermore, since two strings wrap around both faces of the frame, each in a single direction, to form the two parallel playing surfaces, uneven pulling of the frame is avoided when the frame is strung.

Using two wrap-around strings to form the two playing surfaces allows the non-striking surface to resonate along with the striking surface when a ball is struck, thereby allowing the frame to absorb the shock more evenly.

The wrap-around design of this invention, which positions the strings higher than the frame, minimizes the area of the frame edges that a ball can contact, resulting in increased ball control, higher ball velocity and a significant reduction in playing errors.

Finally, the racquet of this invention is simple and inexpensive to manufacture.

Persons skilled in the art will recognize that many modifications may be made to the invention described in this application without departing from the spirit of the invention which is disclosed and claimed.

DETAILED DESCRIPTION OF THE INVENTION

Figure 1:
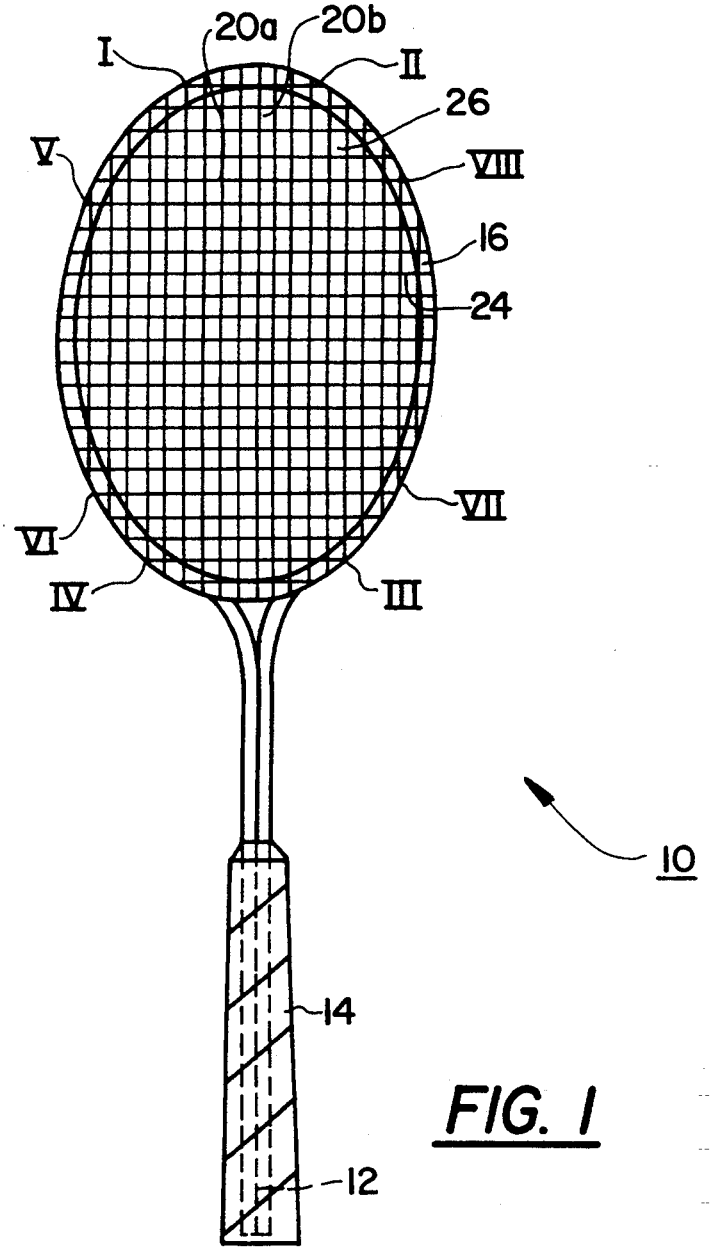
FIG. 1 is a front view of a racquet of the invention.

Referring to FIG. 1, a playing racquet 10 has a handle 12 partially covered with padded cover 14, an elliptically shaped headframe 16 strung with two tensioned strings, a horizontal string 24 and a vertical string 26, to form to parallel playing surfaces 20*a*, 20*b* having interwoven vertical and horizontal components.

Horizontal string 24 is used to form the horizontal lines or components of both playing surfaces 20*a*, 20*b*, and the vertical string 26 is used to form the vertical components of both of the playing surfaces 20*a*, 20*b*. The horizontal components formed by horizontal string 24 cover the headframe 16 in the area bounded by the lines I–II and IV–III and by the outer circumference of the headframe (the horizontal area). The vertical components formed by vertical string 26 cover the headframe 16 in the area bounded by the lines V–VI, VII–VIII, and by the outer circumference of the headframe (the vertical area). For each of the playing surfaces 20*a*, 20*b*, the strings 24 and 26 are conventionally tensioned and interwoven.

Figure 2:
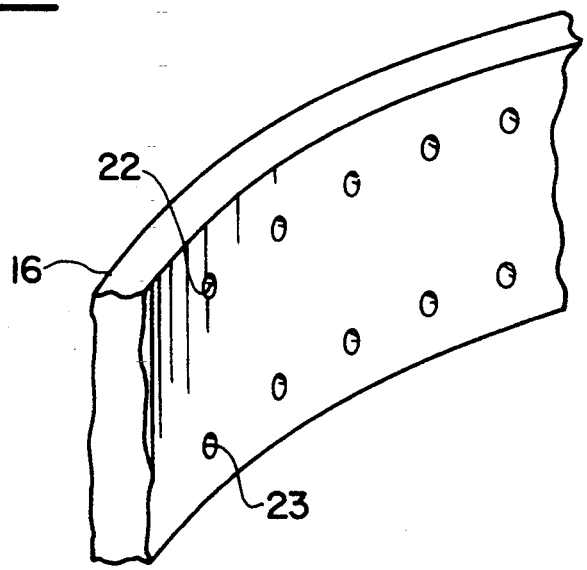
FIG. 2 is a detailed view of the headframe of the racquet of FIG. 1.

Referring to FIGS. 1 and 2, in some embodiments the headframe 16 is formed using an elongated band of constant width with a rectangular cross section. Holes 22, 23 are formed through the headframe. For the purposes of this description, one row of holes is denoted the top row of holes 22, and the other row of holes is denoted the bottom row of holes 23. Each hole 22 in the top row is above a corresponding hole in the bottom row. It will be clear in the description that follows that the references to top holes 22 and bottom holes 23 can be interchanged.

In some embodiments the headframe 16 has a non-rectangular cross section.

Figure 3A:
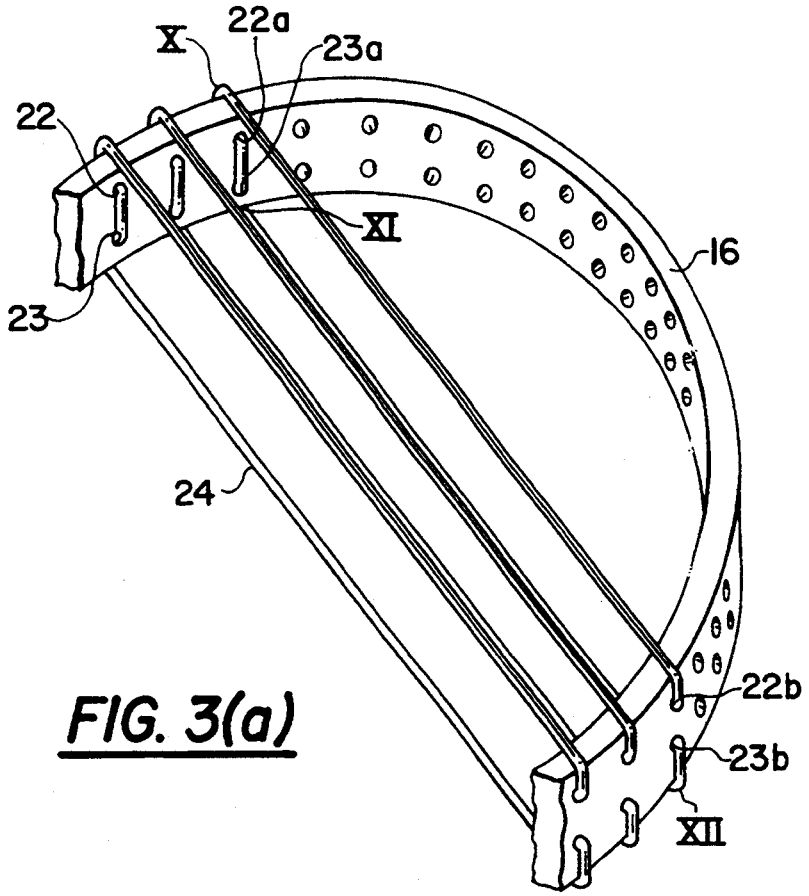
FIGS. 3(*a*)–3(*b*), 4(*a*)–4(*b*), 5(*a*)–5(*b*), 6, 7(*a*)–7(*e*), and 8 are detailed views showing the detail structure and method used in stringing the racquet of FIG. 1.
Figure 3B:
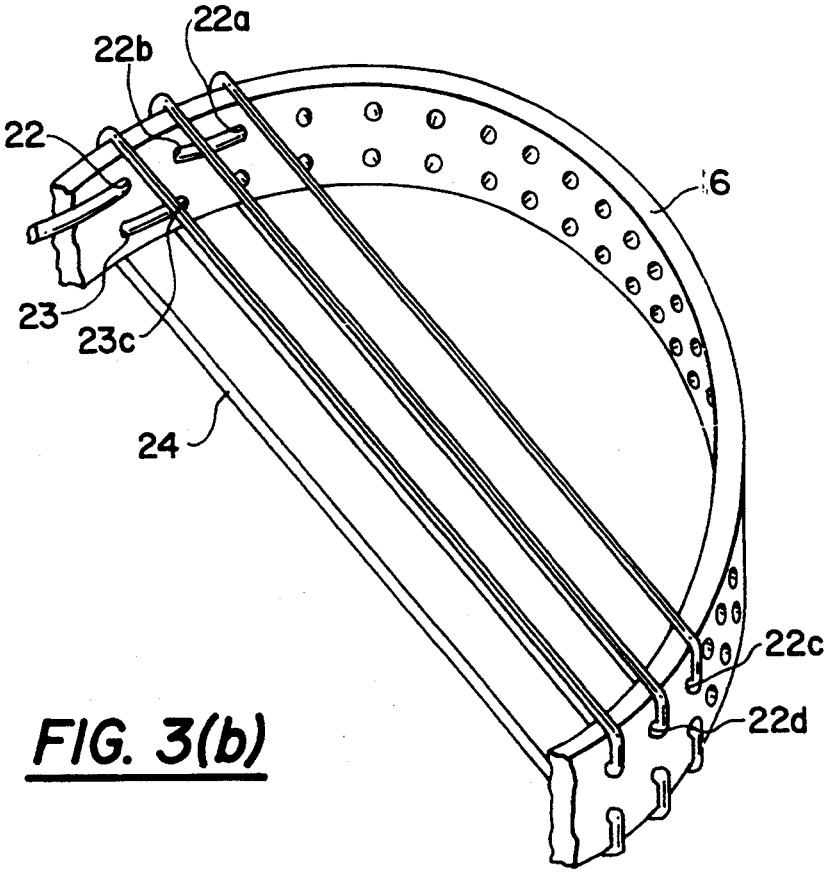

With reference now to FIGS. 1, 3(*a*) and 9(*a*) and 9(*b*), the horizontal components of playing surfaces 20*a*, 20*b* are formed by wrapping the horizontal string 24 through the holes 22, 23 and over the outside edges of headframe 16. On one side of the headframe 16 the string 24 is passed over the top edge of headframe 16 at position X, through the outside of a top hole 22*a* to the inside of the headframe. Then the string 24 is passed vertically down and threaded through the inside of the nearest (corresponding) bottom row hole 23*a* and passed to the outside edge of headframe 16. Then it is passed back under the outside edge of headframe 16 at position XI and then across to the opposite side of the headframe at position XII and then through hole 23*b*. This process is repeated until the entire horizontal area is covered.

Referring to FIG. 3(*b*), on the other side of the headframe 16 the string 24 is threaded over the top edge of headframe, through hole 22*a* from the outside, horizontally to an adjacent top hole 22*b*, through hole 22*b* to the outside of the headframe 16, and then back over the top edge of the headframe to the opposite side of the headframe. There the string 24 passes over the top outside edge and through a top hole 22*d*.

Referring to FIGS. 3(*a*)–3(*b*) and 6, clearly if one side (left or right) of the headframe is threaded with the vertical threading motion, then the other side is threaded with the horizontal threading motion. Thus, for example, if the left side of the frame is threaded as shown in FIG. 3(*a*) to move the string from the top playing surface 20*a* of the headframe 16 to the bottom playing surface 20*b* of the headframe, then the right side of the headframe will be threaded as shown in FIG. 3(*b*) to position the string to the left or right of its current position on the same playing surface.

In summary, the string is threaded so that the holes on one side of the headframe are used to locate the string to form adjacent string components on the same playing surface, whereas the holes on the opposite side of the headframe are used to locate the string alternately between the two playing surfaces.

Figure 4A:
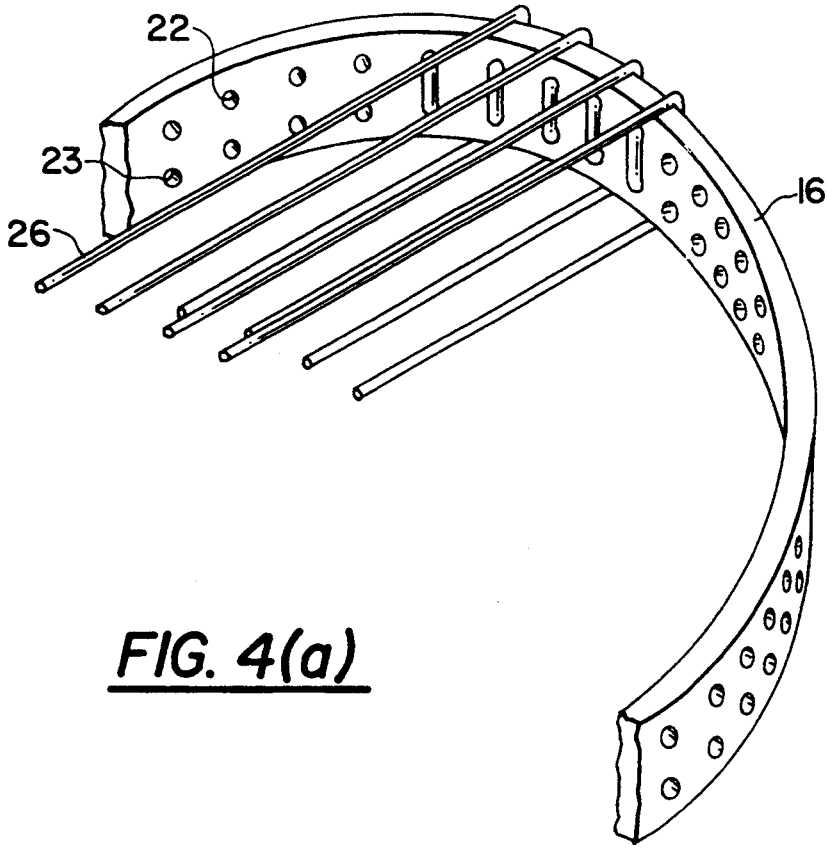
Figure 4B:
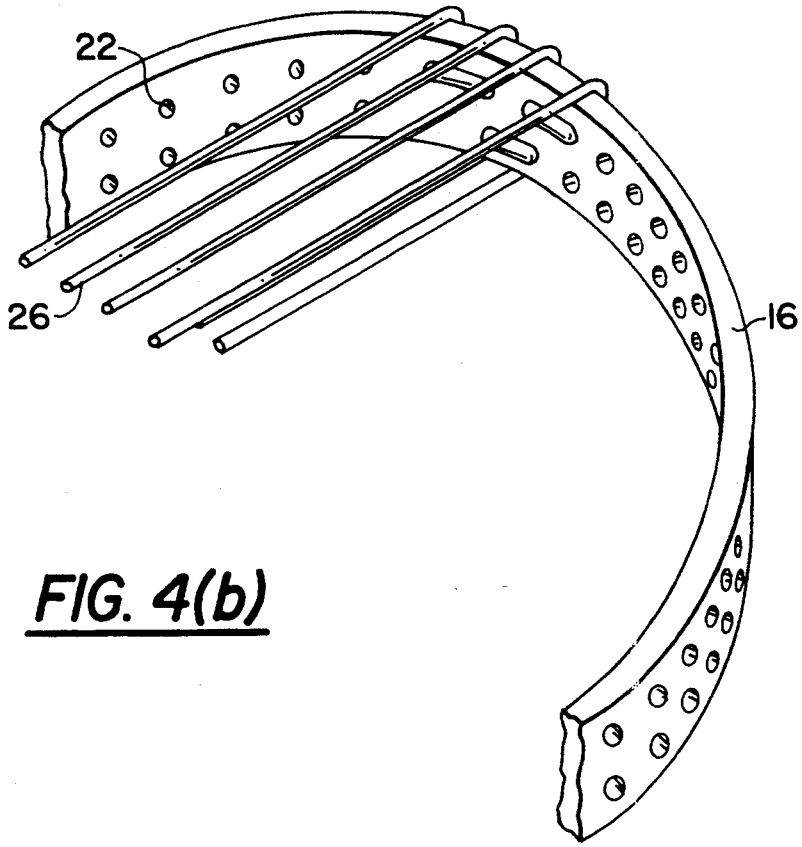
Figure 5A:
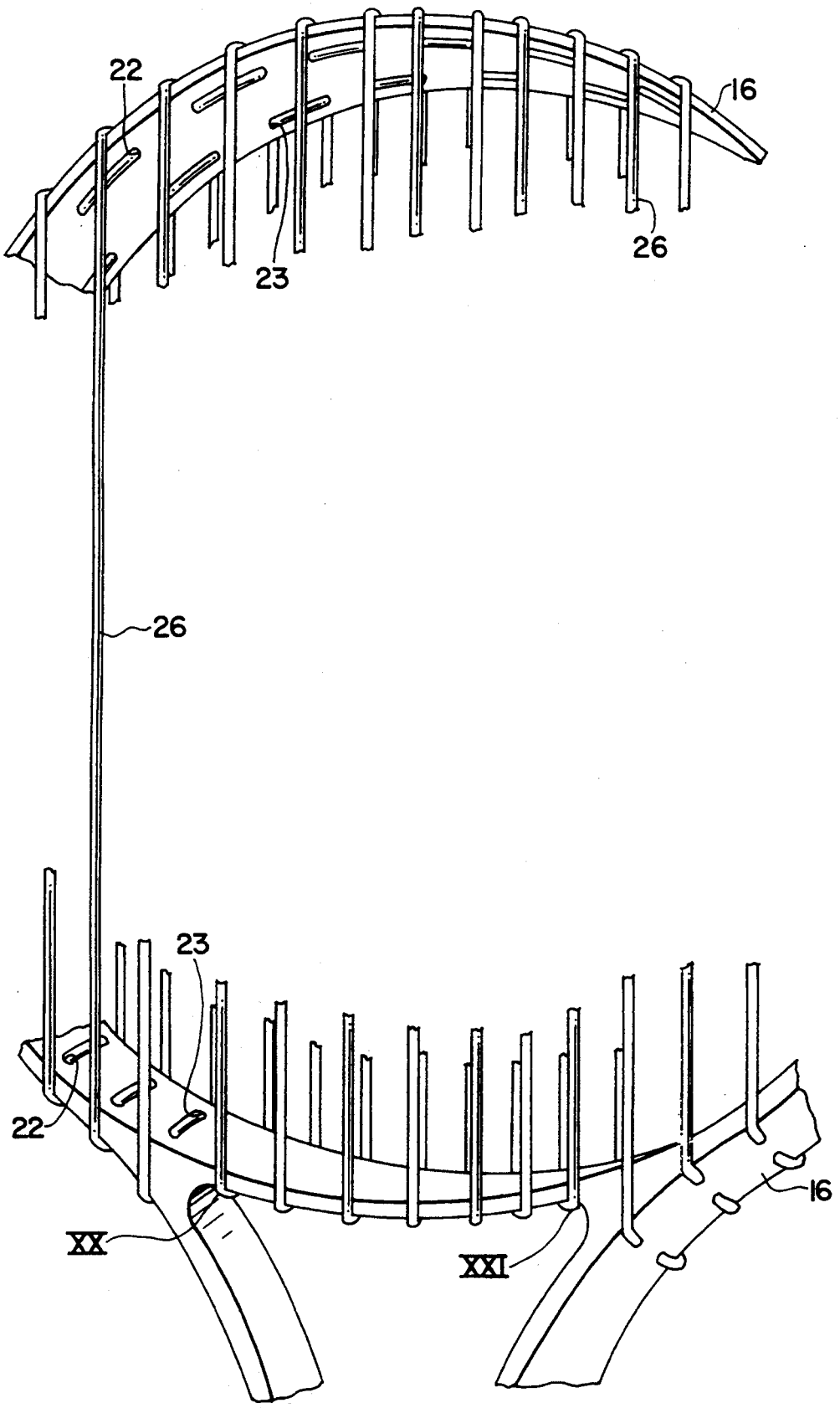
Figure 5B:
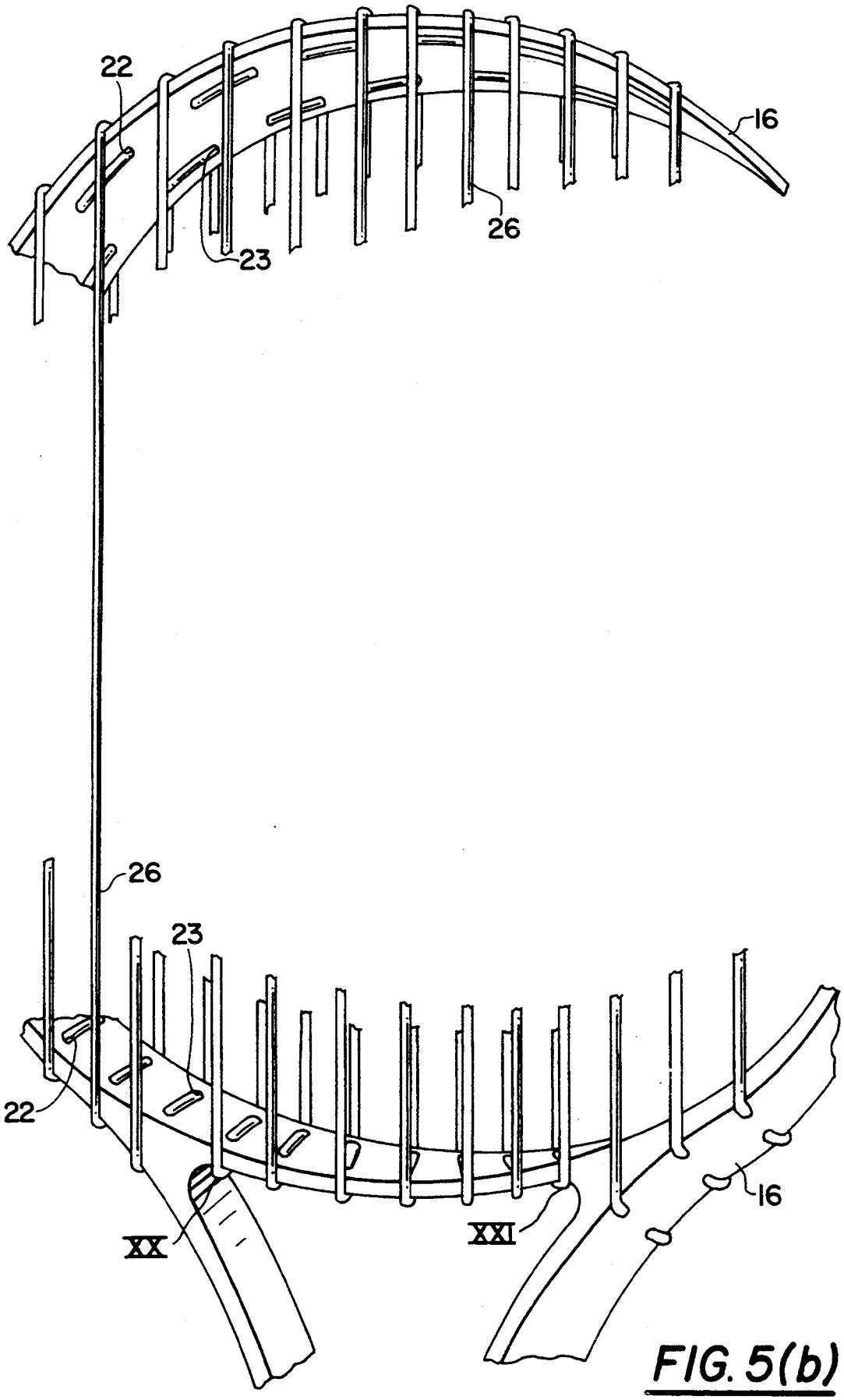
Figure 6:
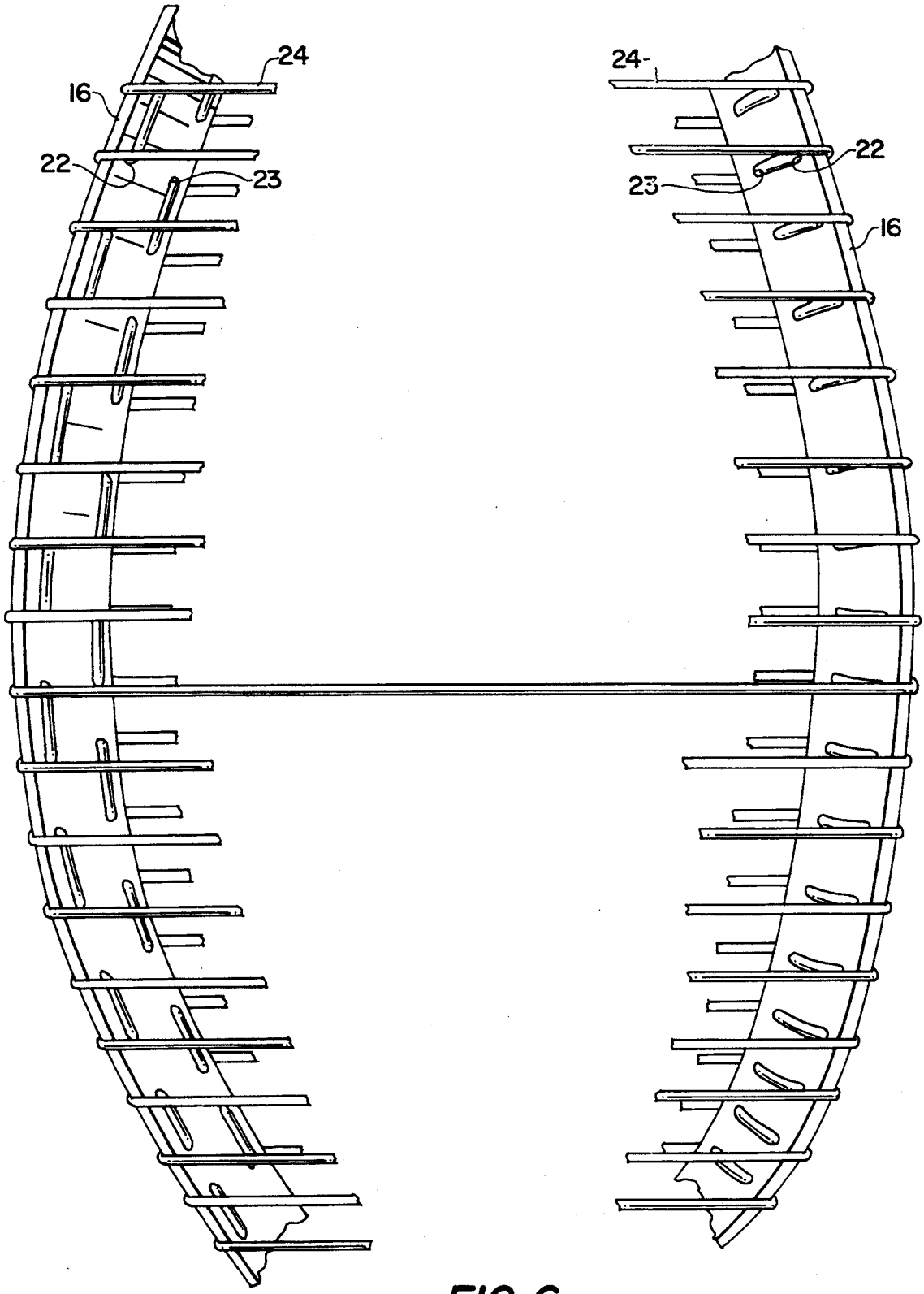
Figure 7A:
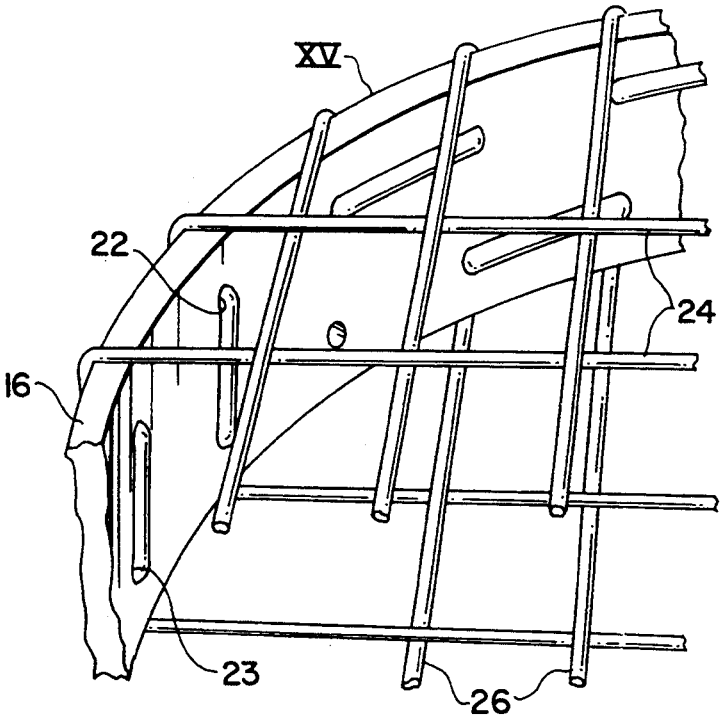
Figure 7B:
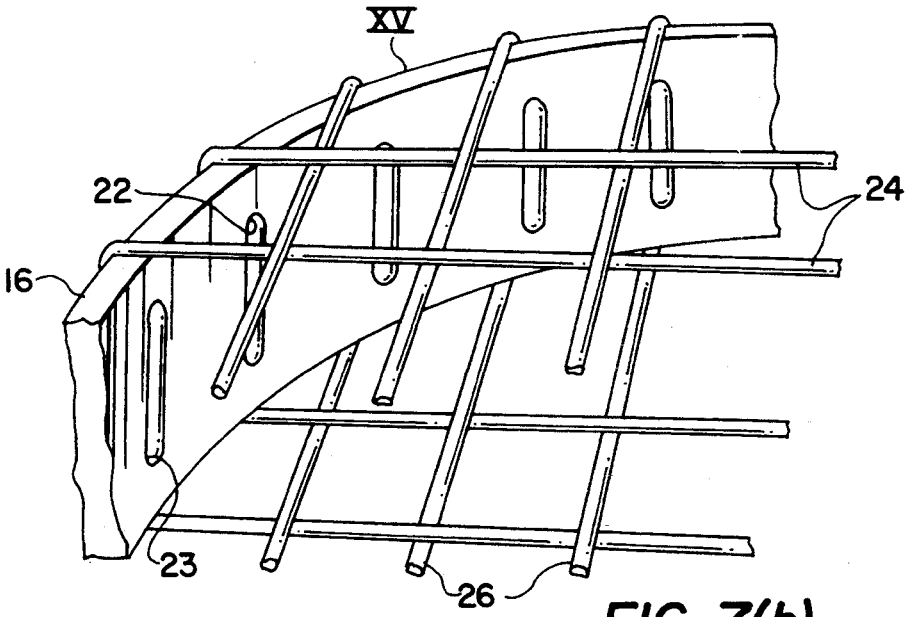
Figure 7C:
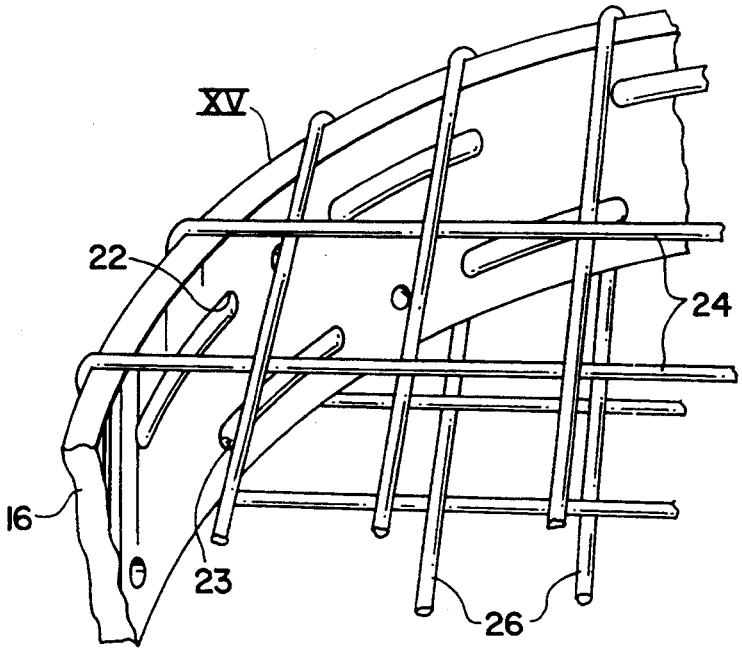
Figure 7D:
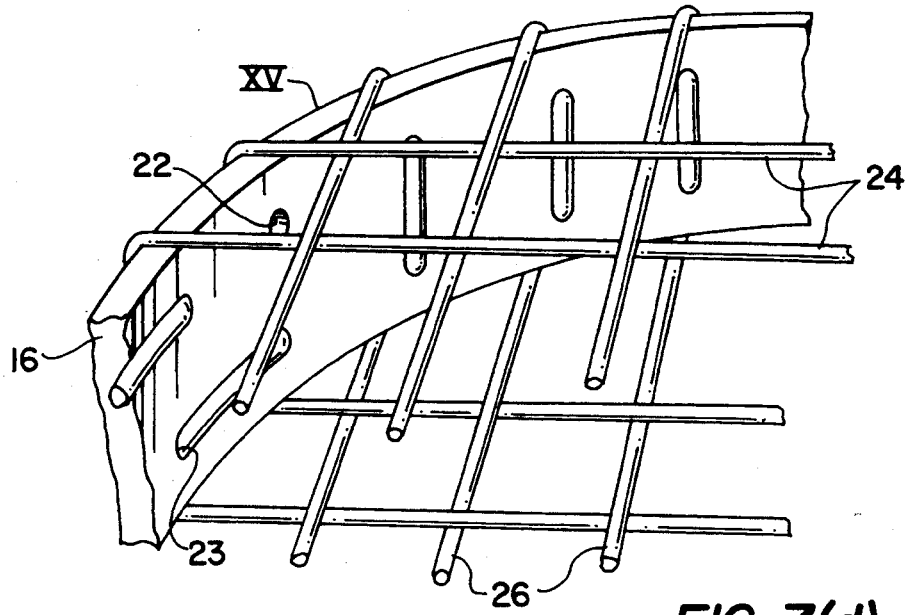
Figure 7E:
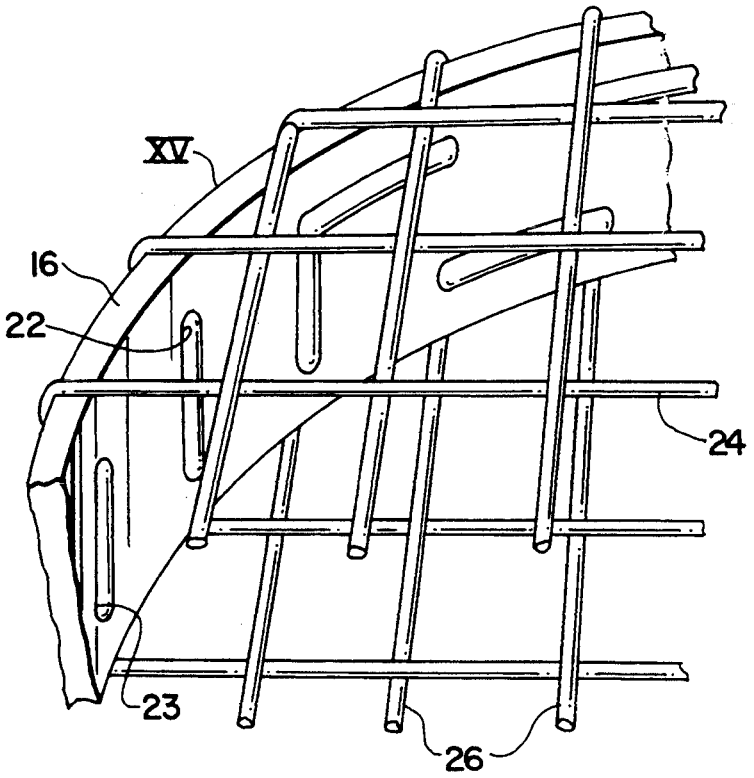

Referring to FIGS. 4 and 5, the vertical string 26 is threaded in a similar fashion to the horizontal string. In FIG. 4(*a*) the vertical string 26 changes playing surfaces at the top of the headframe 16, whereas in FIG. 4(*b*), the vertical string 26 changes direction on the same playing surface at the top of the headframe. As was the case with the horizontal string 24, whichever threading option is chosen for one end of the headframe, the other threading option must be chosen for the other end of the headframe.

Referring to FIG. 5(*a*)–5(*b*), the vertical string 26 can be threaded in two ways at the intersection portion XX–XXI of the headframe 16 and the handle 14. In the situation depicted in FIG. 5(*a*) the string 16 is wrapped around the frame, but not threaded through any holes in the intersecting portion (XX–XXI) of the headframe and the handle. In this instance it may be that no holes are formed in the portion XX–XXI. Alternately, in the situation depicted in FIG. 5(*b*), the threading technique of this invention is applied in the intersection portion (XX–XXI) of the headframe and the handle. If the method shown in FIG. 5(*a*) is used, then notches may be cut in the outside edge of the headframe 16 between positions XX–XXI to act as guides for the vertical string 26.

The horizontal and vertical strings 24, 26 can be strung in any order or simultaneously. They are conventionally interwoven and tensioned.

Referring again to FIG. 1, the vertical string 26 covers the area bounded by positions V, VI, VII, and VIII on the headframe 16, while the horizontal string 24 covers the area bounded by positions I, II, III, and IV on the headframe 16. Thus, the holes 22, 23 in the headframe 16 in the area bounded by positions V, VI, VII, and VIII are used for the vertical string 26, while the holes 22, 23 in the headframe 16 in the area bounded by positions I, II, III, and IV, are used for the horizontal string 24.

In some embodiments positions I and IV, II and VII, III and VII, and IV and VI may coincide or overlap or both. In these cases, the coincident or overlapping holes are used for both the vertical and horizontal strings 24, 26.

FIGS. 7(*a*)–7(*e*) depict some of the possible combinations of situations that occur at the positions on the headframe 16 where the vertical and horizontal strings are both threaded. In each case, the position XV on the headframe 16 corresponds to one of the four locations on the headframe where the horizontal and vertical strings 24, 26 are both threaded.

Figure 8:
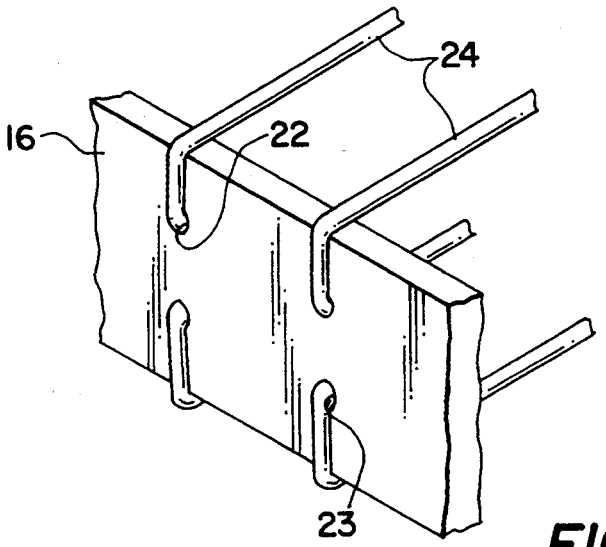
Figure 9A:
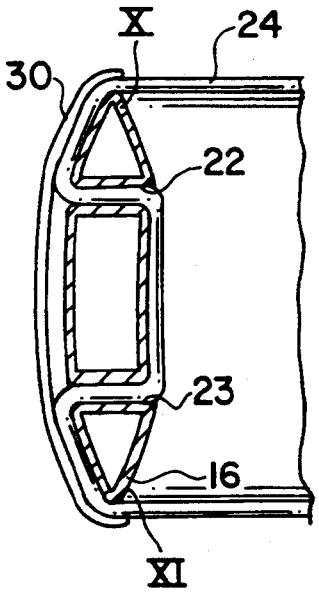
FIGS. 9(*a*)–9(*d*) are cross-sectional side views showing the detail structure and method used in stringing the racquet of FIG. 1.
Figure 9C:
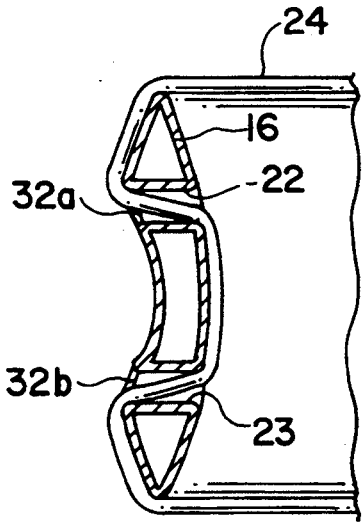
Figure 9B:
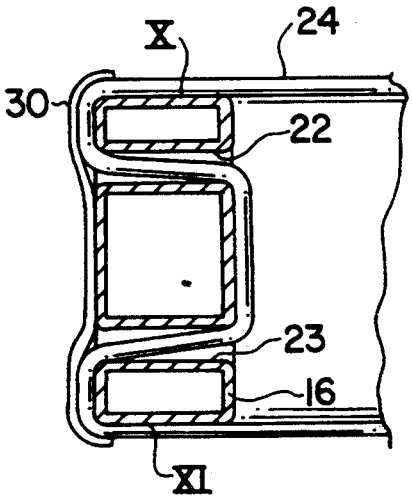
Figure 9D:
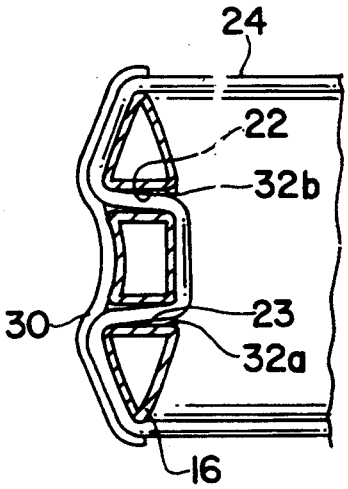

FIG. 8 shows the appearance of the outside of headframe 16 at all points on its circumference. The string 24 (or 26 in the case of the vertical string) passes over the top and bottom edges of the headframe 16 and through the holes 22, 23. On the inside of the headframe the strings move either vertically or horizontally, as described above.

Referring to FIGS. 9(*a*)–9(*b*), showing side views of a metal and a graphite headframe 16, respectively, protective guides 32 may be used to aid threading the strings 24 or 16 through the holes 22, 23.

FIGS. 9(*c*)–9(*d*) show side views of a headframe 16 with protective guides 32*a*, 32*b* in holes 22, 23, respectively. In FIG. 9(*d*) an outer protective guide 30 is used to cover the outside of headframe 16. Protective guides in the holes aid threading and prevent strings breaking. The embodiment shown in FIG. 9(*d*) uses press-in protective guides in the holes to aid assembly and facilitate mass production.

Persons skilled in this art will recognize that other embodiments are within the scope and spirit of the following claims.

What is claimed is:

1. A double-strung game racquet comprising a headframe with two parallel playing surfaces formed thereon using a single horizontal string to form horizontal components of the two surfaces and a single vertical string to form vertical components of the two surfaces, wherein the headframe has two rows of corresponding holes formed therein, and wherein each of the horizontal string and the vertical string repeatedly passes over outer edges of the headframe corresponding to the two playing surfaces and through the holes.

2. A racquet as in claim 1, wherein the horizontal and vertical strings are interwoven separately on each of the surfaces.

3. A racquet as in claim 1, wherein the playing surfaces each form an area at least as large as an area bounded by an external perimeter of the headframe.

4. A racquet as in claim 1, wherein each string is wrapped around the headframe in such a way that the string repeatedly passes over an outside peripheral edge on a first side of the headframe,
across to an opposite side of the headframe,
over an outside peripheral edge of the opposite side,
in through a hole,
out through an adjacent hole,
over another outside peripheral edge of the opposite side, and
across to the first side.

5. The racquet of claim 4, wherein each string is threaded out through a vertically adjacent hole on one side of the headframe and out through a horizontally adjacent hole on the opposite side of the headframe.

6. A racquet as in claim 1, wherein each string repeatedly passes:

across a plane defined by a first one of the two playing surfaces;
over an outer edge of the headframe;
through the holes;
over an outer edge of the headframe; and
across a plane defined by a second one of the two playing surfaces.

7. A double-strung game racquet comprising a headframe with two parallel playing surfaces, each of the surfaces forming an area at least as large as an area bounded by an external perimeter of the headframe and formed on said headframe by a horizontal tensioned string forming horizontal components of the two surfaces interwoven with a vertical tensioned string forming vertical components of the two surfaces, wherein the headframe has two rows of corresponding holes formed therein, and wherein each string is wrapped around the headframe in such a way that the strings repeatedly pass over an outside peripheral edge on a first side of the headframe, across to an opposite side of the headframe, over an outside peripheral edge of the opposite side, in through a hole, out through an adjacent hole, over another outside peripheral edge of the opposite side, and across to the first side, wherein each string is threaded out through a vertically adjacent hole on one side of the headframe and out through a horizontally adjacent hole on the opposite side of the headframe.

8. A method of stringing a double-strung game racquet comprising a headframe with two rows of corresponding holes formed therein and two parallel playing surfaces formed thereon comprising the steps of:

forming horizontal components of the two surfaces with a single horizontal string, and forming vertical components of the two surfaces with a single vertical string;

wherein the steps of forming comprise repeatedly passing the strings over outer edges of the headframe corresponding to the two playing surfaces and through the holes.

9. A method as in claim 8, wherein the steps of forming comprise the steps of:

wrapping each string around the headframe in such a way that the string passes:

over an outside peripheral edge on a first side of the headframe, across to an opposite side of the headframe, over an outside peripheral edge of the opposite side, in through a hole, out through an adjacent hole, over another outside peripheral edge of the opposite side, and across to the first side; and repeating the step of wrapping until the playing surfaces are completely formed.

10. The method of claim 9, wherein the step of wrapping further comprises the steps of threading each string out through a vertically adjacent hole on one side of the headframe, and threading each string out through a horizontally adjacent hole on the opposite side of the headframe.

11. A method as in claim 8, wherein the steps of forming comprise wrapping each string around the headframe in such a way that the string repeatedly passes:

across a plane defined by a first one of the two playing surfaces;

over an outer edge of the headframe;

through the holes;

over an outer edge of the headframe; and across a plane defined by a second one of the two playing surfaces.

12. A method of stringing a double-strung game racquet comprising a headframe with two parallel playing surfaces formed thereon and having two rows of corresponding holes formed therein comprising the steps of:

forming horizontal components of the two surfaces with a horizontal string, and forming vertical components of the two surfaces with a vertical string, wherein the steps of forming comprise the steps of:

wrapping each string around the headframe in such a way that the strings pass over an outside peripheral edge on a first side of the headframe, across to an opposite side of the headframe, over an outside peripheral edge of the opposite side, in through a hole, out through an adjacent hole, over another outside peripheral edge of the opposite side, and across to the first side; and repeating the step of wrapping until the playing surfaces are completely formed, and wherein the step of wrapping further comprises the steps of threading each string out through a vertically adjacent hole on one side of the headframe, and threading each string out through a horizontally adjacent hole on the opposite side of the headframe.

* * * * *